United States Patent [19]

Sommer

[11] 4,333,656

[45] Jun. 8, 1982

[54] DECK OF PLAYING CARDS

[76] Inventor: Steven Sommer, 305 W. 91st St., New York, N.Y. 10024

[21] Appl. No.: 238,886

[22] Filed: Feb. 27, 1981

[51] Int. Cl.[3] ..... A63F 1/00

[52] U.S. Cl. ..... 273/299; 273/304

[58] Field of Search ..... 273/303, 304, 305, 299

[56] References Cited

U.S. PATENT DOCUMENTS

| | | | |
|---|---|---|---|
| 298,991 | 5/1884 | Levey | 273/305 |
| 1,012,574 | 12/1911 | Adams | 273/299 |
| 1,377,327 | 5/1921 | Ebert | 273/299 |

FOREIGN PATENT DOCUMENTS

| | | | |
|---|---|---|---|
| 1461665 | 11/1966 | France | 273/299 |

*Primary Examiner*—Anton O. Oechsle

*Attorney, Agent, or Firm*—Alan H. Levine

[57] ABSTRACT

A deck of playing cards including 104 individual cards divided into four suits of 26 cards each. Each card of each suit bears a suit marking, e.g., hearts, diamonds, clubs, or spades, and a different one of the 26 letters of the English alphabet. Each card of each suit also bears a number representative of the frequency with which the letter borne by that card occurs in words in the English language; the lower numbers correspond to more frequently used letters and the higher numbers correspond to less frequently used letters. The numbers one to thirteen, inclusive, in a consecutive series appear on at least thirteen cards of each suit, and preferably each number between one and thirteen appears on two cards of each suit. If desired, tiles or any other suitable medium for carrying the letters, numbers, and suit markings may be used in place of cards.

2 Claims, 3 Drawing Figures

Figure 14:
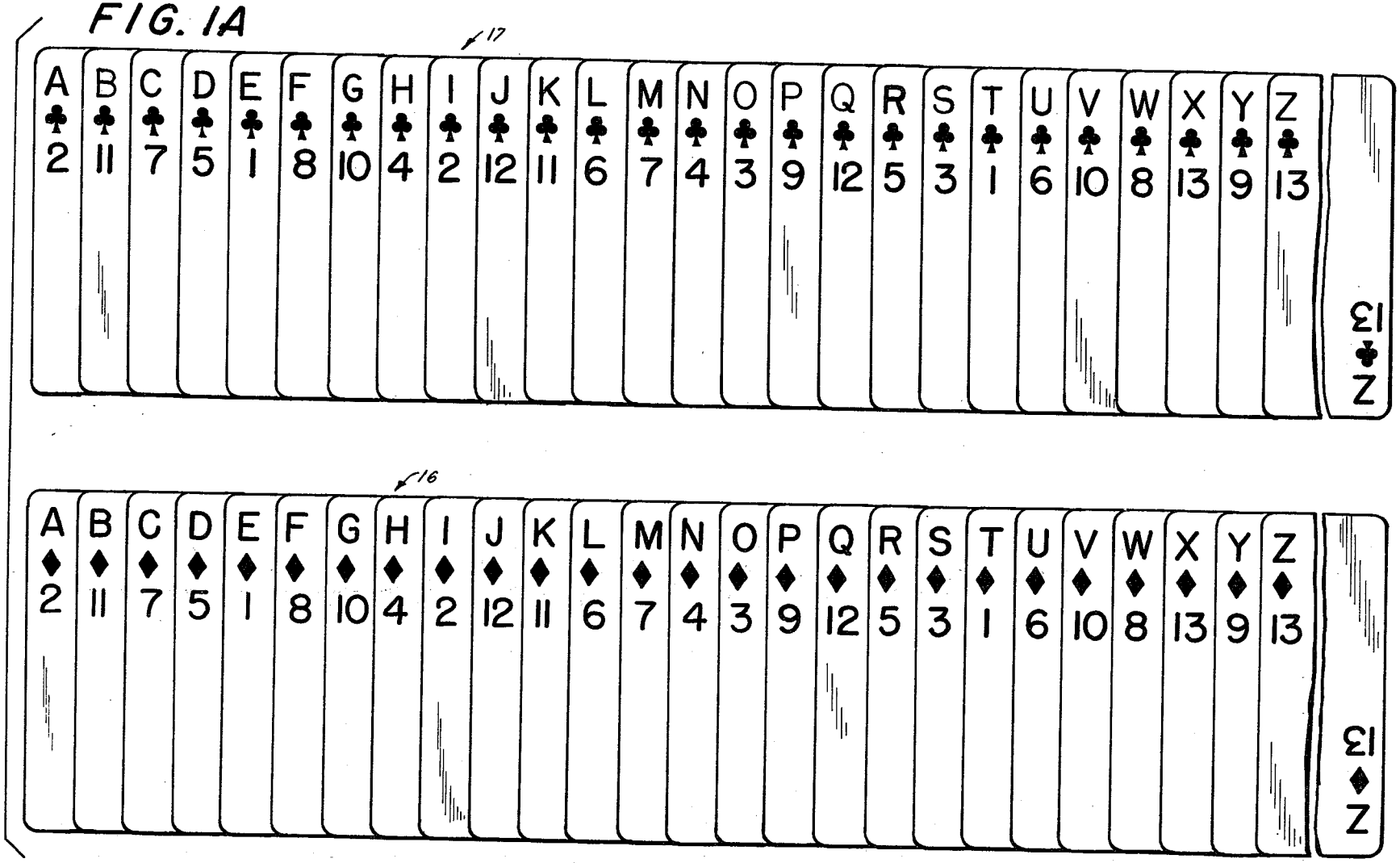

18
21
22
23
15
19
18
A B C D E F G H I J K L M N O P Q R S T U V W X Y Z
2 11 7 5 1 8 10 4 2 12 11 6 7 4 3 9 12 5 3 1 6 10 8 13 9 13
E T A I S O N H R D L U C M F W Y P G V B K J O X Z
1 1 2 2 3 3 4 4 5 5 6 6 7 7 8 8 9 9 10 10 11 11 12 12 13 13

DECK OF PLAYING CARDS

This invention relates to playing cards, and more particularly to a deck of playing cards useful for playing both conventional card games and word games.

A conventional deck of playing cards includes 52 cards divided into four suits of thirteen cards each. The thirteen cards of each suit (hearts, diamonds, clubs, and spades) bear thirteen numbers, or equivalent markings, in a consecutive series, i.e., are (equivalent to the number one), 2 through 10, and jack, queen, king (equivalent to the numbers 11, 12, 13, respectively). Many well-known card games, such as rummy and poker, can be played with such a deck.

Decks of cards are also known wherein each card bears a letter or letters of the alphabet. Such cards are used to play word games in which players assemble groups of cards in side-by-side relationship so as to spell words. These games may or may not involve awarding point scores for the words created by the different players.

It is an object of the present invention to provide a deck of cards useful for playing all the games which can be played with a conventional deck of cards, as well as a variety of word games.

It is another object of the invention to provide such a deck of cards which when used to play a word game permits players to be awarded points corresponding to the difficulty of the words which they create. In this connection, words are considered to be more "difficult", and hence of higher point value, if they contain letters less frequently found in English language words.

It is a further object of the invention to provide a deck of cards of the type described which permits the usual four suits to be involved in word game play, so as to increase the variety of word games which can be played, and increase the variety of scoring possibilities when the cards are used.

It is an additional object of the invention to provide a deck of playing cards which retains all the symmetry of two conventional decks of cards, and provides the additional dimension of word game play in such a way that the usual number value of the playing cards is logically related, for scoring purposes, to the letters carried by the cards.

Additional features and advantages of the invention will be apparent from the following description in which reference is made to the accompanying drawings.

Figures 1B, 2:
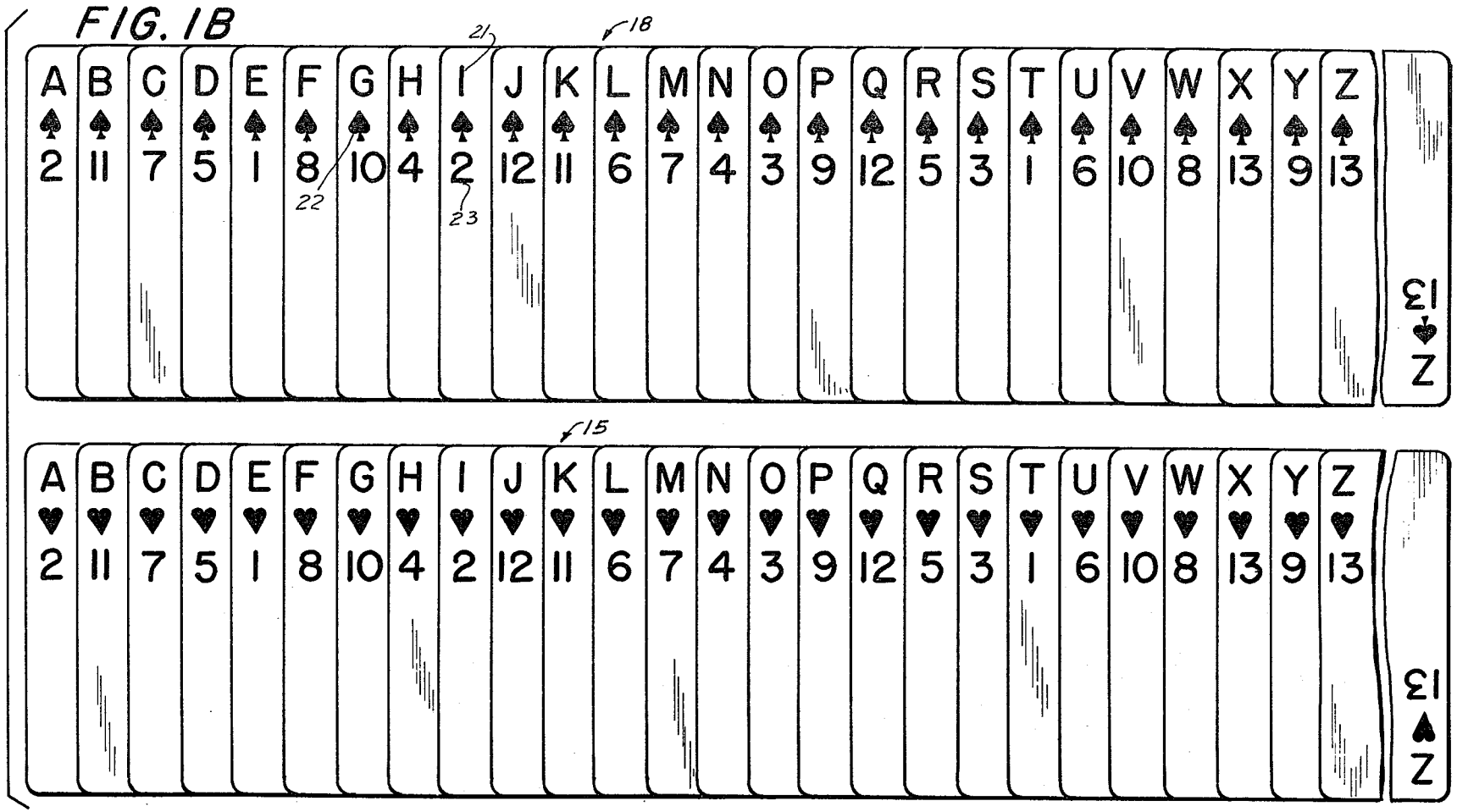

In the drawings:

FIGS. 1A and 1B are face views of the cards of a deck according to the present invention, the cards of each suit overlapping each other to conserve space on the drawing sheet; and FIG. 2 is a chart illustrating the point value of each letter of the alphabet.

A deck of cards according to this invention is illustrated in FIG. 1 and contains 104 cards. The deck is divided into four suits 15, 16, 17, and 18 of 26 cards each. Thus, there are 26 cards in the "hearts" suit 15, 26 cards in the "diamonds" suit 16, 26 cards in the "clubs" suit 17, and 26 cards in the "spades" suit 18.

Each card of each suit bears a different letter of the 26 letter English language alphabet. Thus, in the hearts suit 15, there is an A of hearts, a B of hearts, a C of hearts, and so forth through to the Z of hearts. Similarly, there are A through Z cards in each of the diamonds, clubs, and spades suits.

FIG. 2 illustrates along the top horizontal line 19 the 26 letters of the English alphabet arranged, according to some authorities, in the order of their frequency of use in the language. In other words, the letter E is the letter which occurs most frequently in English words, the letter T occurs next most frequently, and so forth through to the letter Z which occurs least frequently. Along the bottom horizontal line 20 of FIG. 2 are a series of pairs of numbers arranged consecutively from one to thirteen, each number being directly beneath a letter in line 19. Thus, the two most frequently used letters E and T each correspond to the number one, the next two most frequently used letters A and I each correspond to the number two, and so forth through to the two least frequently used letters X and Z, each of which corresponds to the number thirteen.

As may be seen in FIG. 1, each card of the deck carries, in addition to a letter of the alphabet 21 and an indicium 22 indicating its suit, a number 23 allocated according to the chart of FIG. 2. Thus, a card bearing the letter A also carries the number two, a card bearing the letter B also carries the number eleven, and so forth.

The numerals 23 on the cards serve two functions. When the deck is being used to play a word game, the numerals indicate the point value of each card. Consequently, a player who forms a word using cards bearing infrequently used letters of the alphabet is rewarded with a higher point score than another player who forms a word using more frequently used letters. For example, forming a word containing the letters B through Z in line 19 of FIG. 2 results in a higher score than a word formed with the letters E through O in line 19. It will be seen therefore that, generally speaking, the less frequently a letter on a card is used in English, the higher the point value of the card.

There is not a linear relationship between the frequency of use of a letter and the point value of its respectiave card. In other words, the letter E is not used thirteen times more frequently than the letter Z, and the letter H is not used twice as frequently as the letter W. For the purposes of the present invention, it is important that a higher point score is awarded for forming words including less frequently used letters of the alphabet. It is also important that all the numbers one through thirteen, inclusive, are used on the cards.

The second function of the numbers 23 on the cards comes to the form when it is desired to play a conventional card game, such as rummy or poker, with the cards. In this case, the 104 card deck can be divided into two conventional 52 card decks. Each suit contains two series of cards numbered one through thirteen. If each card bearing the number one is considered an ace, and if the cards bearing the numbers 11, 12, and 13 are considered equivalent to the jack, queen, and king, respectively, the 26 cards of each suit can be divided into two conventional thirteen card suits. As a result, two conventional decks of cards, each containing four thirteen card suits, can be obtained.

The importance of numbering the cards with consecutive point values from one to thirteen will be apparent. While these point values are related to the frequency of use of the letters borne by the cards, the consecutive numbering permits the cards to optionally be used in the number of a conventional deck of playing cards. Thus, the numbers 23 not only represent point values for the various letters of the alphabet, but also constitute the sole means for ranking the cards when conventional card games are played.

In FIG. 2, bottom line 20 could contain the consecutive numbers one through 26, and these members used on the cards. Such an arrangement would work well from the point of view of scoring when a word game is played. However, in such a case, only one conventional 52 card deck could be obtained from those cards bearing the numbers one through thirteen. The cards bearings the numbers fourteen through 26 would be useless for playing conventional card games. Thus, the advantage of using each of the numbers one through thirteen twice is that the 104 card deck of this invention can then be divided into two useable 52 card conventional decks.

Word games according to many different rules can be played with the present deck of cards. For example, each of two players may be dealt a hand of 15 cards, and the remainder of the deck placed face down between them. The players arrange cards within their hands attempting to form words or "sets"; a set is an assembly of three of four cards all bearing the same letter.

The players in turn pick cards from the deck and discard cards face up into a discard pile; as the game progresses, during each turn a player may pick either from the deck or from the discard pile. As players assemble words having a minimum of four letters or sets having a minimum of three cards, these are placed face up on the table. The hand is over when one of the players arranges all his cards into words and/or sets. The point values of the cards comprising the words and sets deposited by the players are totaled, the player left with cards in his hand substracting the points of those cards from his assembled words and sets total. The score for a set may be the total point value of the cards forming the set; the score for a word may be double the total point value of the cards forming the word; and the score for a word flush, wherein all the letters are of the same suit, may be triple the total point value of the cards forming the word flush.

Although the invention has been described with reference to cards, i.e., rectangular pieces of paperboard material, it is contemplated that the "deck" could be an assortment of 104 tiles, such as are used in the well-known game sold under the trademark "Scrabble". Therefore, it is to be understood that wherever the words "card" or "cards" are used in this specification and the following claims, those words are intended to include tiles or any other medium capable of carrying the letters 21, markings 22, and numbers 23 shown in the drawings.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A deck of playing cards comprising 104 individual cards, the cards of the deck being divided into four suits of 26 cards each, each card of each suit bearing, in addition to its respective suit marking, a different one of the 26 letters of the English alphabet, and each card of each suit also bearing a number representative of the frequency with which the letter borne by the card occurs in words in the English language, the more frequently used letters corresponding to lower numbers and the less frequently used letters corresponding to higher numbers, said numbers being one to thirteen, inclusive, in a consecutive series appearing on at least thirteen cards of each suit, said numbers constituting the sole means for ranking the cards in each suit.

2. A deck of playing cards as defined in claim 1 wherein each card of each suit bears a number between one and thirteen, inclusive, each number between one and thirteen appearing on two cards of each suit.

* * * * *